United States Patent [19]

Doolan

[11] Patent Number: 4,900,073

[45] Date of Patent: Feb. 13, 1990

[54] PRIVACY DOOR LATCH

[75] Inventor: Martin P. Doolan, Duncanville, Tex.

[73] Assignee: TCI International Inc., DeKalb, Tex.

[21] Appl. No.: 339,947

[22] Filed: Apr. 17, 1989

Related U.S. Application Data

[63] Continuation of Ser. No. 141,351, Jan. 15, 1988, abandoned, which is a continuation-in-part of Ser. No. 48,049, May 15, 1987, Pat. No. 4,720,127.

[51] Int. Cl.[4] ..... E05C 1/16

[52] U.S. Cl. ..... 292/169.22; 292/359; 292/DIG. 26

[58] Field of Search ..... 292/150, 169.22, 169.19, 292/352, 359, DIG. 26

[56] References Cited

U.S. PATENT DOCUMENTS

| | | | |
|---|---|---|---|
| 1,688,240 | 10/1928 | Keigwin | 292/359 |
| 2,390,756 | 12/1945 | Voight | 292/169.22 X |
| 2,420,114 | 5/1947 | VanderHenst | 292/169.22 X |
| 2,723,874 | 11/1955 | Hillgren | 292/359 X |
| 2,743,600 | 5/1956 | Heyer | 292/169.19 X |

*Primary Examiner*—Richard E. Moore

*Attorney, Agent, or Firm*—Kanz, Scherback & Timmons

[57] ABSTRACT

A door latch includes an elongated stationary case and a latch bolt mounted to reciprocate longitudinally in the case between outwardly extended and inwardly retracted positions. The latch bolt is driven between the two positions by a driver mechanically connected to the latch bolt and longitudinally movable within the case under control of first and second cams. The rotation of either cam will cause the driver to move against the force of a helical spring in direction to pull the latch bolt to an inwardly retracted position. A pushbutton key is mounted to a sidewall of the case and movable in direction into and out of the case to lock one of the cams against rotation. A pin, integral with and extending radially from said key, is received by a camming means on the other cam whereby rotation of the other cam will move the pin in direction to retract the key from the first mentioned cam. A detent in the case is held in position by the helical spring to frictionally engage the outer surface of the key.

10 Claims, 3 Drawing Sheets

PRIVACY DOOR LATCH

This application is a continuation of application Ser. No. 07/141,351, filed Jan. 15, 1988, now abandoned, which is a continuation-in-part of application Ser. No. 7/048,049 filed May 15, 1987 for Door Latch now U.S. Pat. No. 4,720,127, issued Jan. 19, 1988.

BACKGROUND OF THE INVENTION

The present invention is directed generally to the door lock and latch mechanism arts, and more particularly to a unique operator comprised of two cams, each individually operated to cause a latch bolt to move between outwardly extended and inwardly retracted positions.

Door latch assemblies are available to enable one to lock and to release the assembly from one side of a door utilizing a push button key. These latches find use with bathroom and bedroom doors. For the most part, these assemblies possess the desireable features of movement of the door handles or knobs independently of one another and also provide for release of the locking mechanisms by rotation of the inner door handle or knob in either clockwise or counterclockwise direction. Door latches possessing these features are, however, for the most part complex, expensive to manufacture and difficult to install. Moreover, presently available door latches with the push button key locking feature, for use on bathroom or bedroom doors, are comprised of mechanisms which as a whole do not lend themselves to repair, such that upon the occurrence of a fault or a breakdown of the mechanism, it is necessary to replace the entire assembly. Other door latches of more simple construction do not possess the locking feature.

In U.S. Pat. No. 4,720,127 there is described a door latch having an elongated stationary case. A latch bolt is mounted to reciprocate longitudinally in the case between outwardly extended and inwardly retracted positions. An operator within the case is rotatable about an axis extending transversely through the case to cause a driver to move the latch bolt longitudinally in response to rotation of the operator. The driver includes a latch slide which is urged to a forward position in the case by means of a compression spring. The operator is comprised of a first cam and a second cam, each having top and bottom portions engaging the driver to enable the driver by rotation of the operator in either a clockwise or counterclockwise direction. A push button key is provided moveably mounted to a sidewall of the case and moveable in the direction into and out of the case without engaging the second cam. The first cam has a portion for receiving at least a part of the push button key for locking the first cam against rotation when the key is in the receiving portion. With the key in the receiving portion, the first cam is locked against rotation and therefore the door latch cannot be operated from the outside of the door to which the latch is mounted. The second cam has a camming means formed in the surface adjacent the sidewall of the case and receives a pin mounted on the push button key such that the rotation of the second cam will engage the pin and move the push button key out of the receiving portion of the first cam. This effectively unlocks the door and permits the opening and closing of the door from either side.

SUMMARY OF THE INVENTION

It is an object of the present invention to provide a door latch having an improved security feature including a push button key which may be locked from the inside of a room and the lock released by rotation of the door handle in either direction and thus avoid panic on the part of the occupant of the room, particularly among the young, infirmed or handicapped.

In accordance with the present invention a push button key has an elongated cylindrical portion extending into the latch case and having a pin extending radially therefrom for movement into and out of engagement with a first cam for locking and unlocking the latch. The latch case is comprised of two halves which when assembled provide structure for receiving detent means. The detent means is urged with engagement with an outside surface of the cylindrical portion by a compression spring to reduce free movement of the push button key and cooperates with a circumferential on the surface of the cylindrical portion to hold the push button key in an unlocking position until the latch is intentionally to be locked.

Further in accordance with the present invention there is provided a plastic guide bushing for the push button key. The guide bushing extends through a wall of one of the halves of the casing and has a central passageway for receiving the body of the key.

DESCRIPTION OF THE DRAWINGS

The foregoing, as well as other objects, features and advantages of the invention will be more readily appreciated upon consideration of the following detailed description of the illustrated embodiment, together with the accompanying drawing wherein.

DETAILED DESCRIPTION OF THE ILLUSTRATED EMBODIMENT

Figure 1:
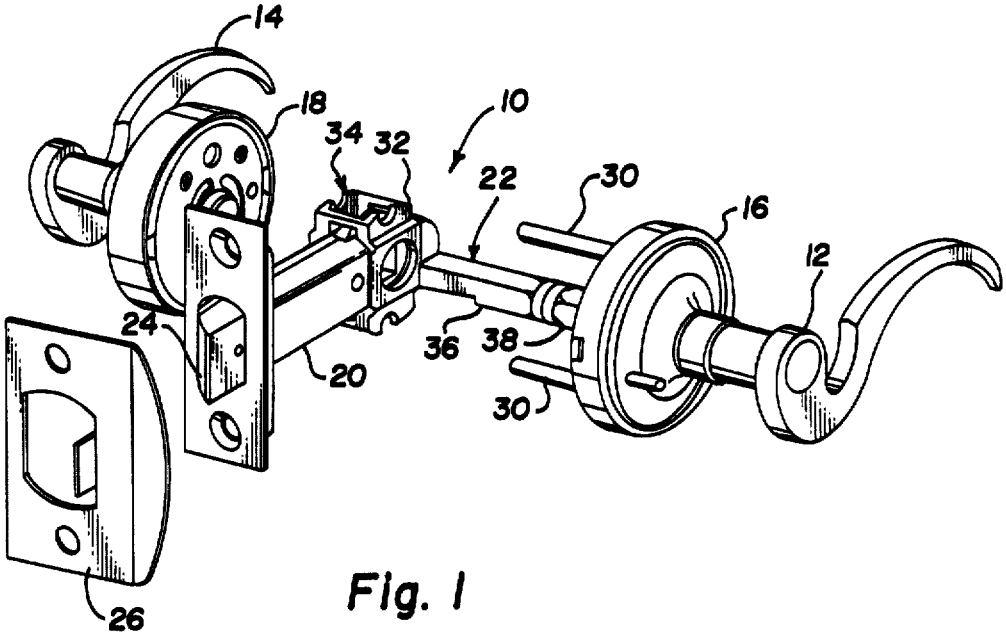
FIG. 1 is an exploded perspective view of a door latch assembly embodying the present invention.

Referring now to the drawings and initially to FIG. 1, a door lever or knob assembly embodying features of the present invention is designated 10. The assembly includes door handle or knob 12 intended for placement on one side of a door and door handle or knob 14 intended to be placed on an opposite side of the door. Associated with the handles or knobs 12 and 14 respectively are escutcheon plates 16 and 18. The latching mechanism is contained within case 20 through which a spindle 22 passes into engagement with an operator (not shown) to move latch bolt 24 and cause it to reciprocate longitudinally in the case 20 between outwardly extended and inwardly retracted positions and cause the bolt to engage or disengage striker plate 26. Associated with handle 12 and escutcheon plate 16 are a pair of spaced parallel rods 30 which are internally threaded to receive machine screws associated with the escutcheon plate 18 for securing the assembly to a door. A guide means 32 is slidably mounted on the exterior of the case 20 and provides for ready location of the machine screws relative to the rods 30. This is effected by having surface 34 of guide means 32 lie in the same plane as the ends of the rods 30. The result is a fairly broad solid contact area substantially surrounding the threaded openings in the rods 30. The ends of the machine screws will engage the contact area and be limited in movement to avoid passing the ends of rods 30 and thus enabling the movement of the end of each machine screw into engagement with the threaded opening of its respective rod 30. The guide 32 is preferably made of plastic.

Segments 36 and 38 of spindle 22 are in end butting relation and secured for relative rotation one with respect to the other. Thus when the door latch assembly is mounted in the door, the first segment 36 only of spindle 22 will be operated by the door handle 14 to move the latch bolt inwardly and outwardly and the second segment 38 of the spindle 22 will be effective in conjunction with the handle 12 only to move the latch bolt inwardly and outwardly with respect to the case 20.

Figure 2A:
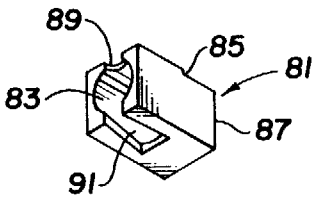
FIG. 2A is an enlarged perspective view of a guide means for a .locking pin also shown in FIG. 2.
Figure 2:
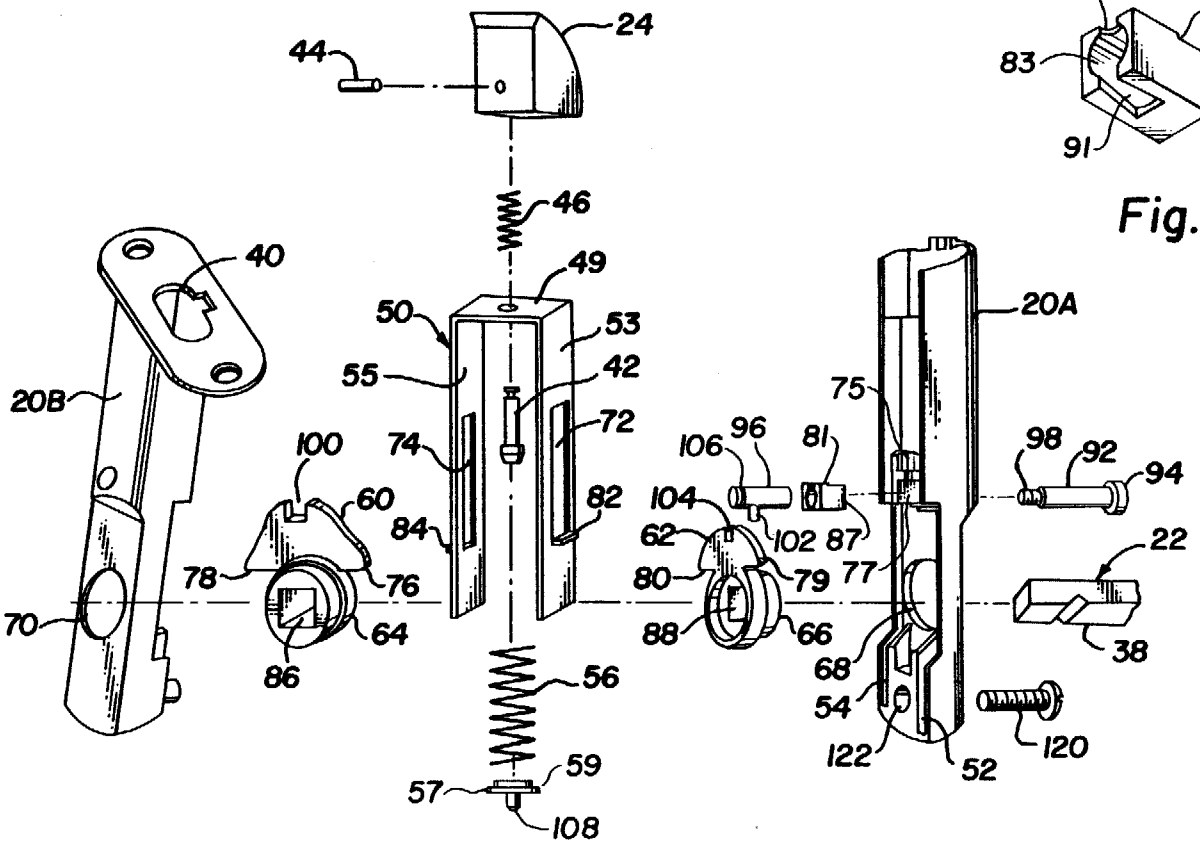
FIG. 2 is an exploded view of the latch mechanism embodying features of the present invention.

Referring now to FIG. 2, the case 20 of FIG. 1 is shown comprised of two elongated halves 20A and 20B. An aperture 40 at the end of case half 20B receives the latch bolt 24 which is secured to one end of lever pin 42 by pin 44. A compression spring 46 surrounds pin 42 and urges the latch bolt 24 away from base 49 of a U-shaped latch slide 50 which is mounted for reciprocating motion within the case 20. Movement of the latch slide is guided by grooves 52, 54 which extend along the lengths of the halves 20A, 20B of case 20. The latch slide 50 is urged forward in the case 20 by way of resilient means 56, a helical spring, one end of which is in contact with the under surface of the base 49 of the latch slide 50 and the other end of which engages a shoulder 57 formed on detent means 59. With the latch slide 50 in its forward position, the latch bolt 24 is in an outwardly extended position as shown in FIG. 1. When the latch slide 50 is moved in an opposite direction within the case 20, it will draw or drive the latch bolt 24 to an inwardly retracted position. The driver comprised of the latch slide 50 is moved in the rearward direction by an operator comprised of cams 60 and 62. Each of the cams 60, 62 has a hub of circular outer configuration. More specifically, cam 62 has hub 66 received by a circular hole 68 passing through the sidewall of casing part 20A and cam 60 has hub 64 received by a circular hole or aperture 70 passing through the casing part 20B. The cams 60, 62 are rotatable about an axis extending transversely through the case 20.

The latch slide 50 has legs 53 and 55 respectively provided with longitudinal slots 72 and 74 which receive top portion 76 and bottom portion 78 of cam 60 and top portion 79 and bottom portion 80 of cam 62. The top and bottom portions of the cams 60 and 62 extend respectively into and through the slots 72 and 74 beyond the outer surfaces of legs 53 and 55 to engage shoulders 82 and 84 formed respectively at the rearward ends of the slots 72 and 74 to provide a camming action. The rotation of either of the cams 60 or 62 on their respective hubs will cause the latch slide 50 to be moved to its retracted position, moving the latch bolt 24 to its inwardly retracted position.

The body portion of each of the cams 60 and 62 are respectively provided with noncircular holes 86 and 88 which extend through the hubs 64 and 66 to receive the spindle 22. In the commercial embodiment of the present invention, the holes 86 and 88 are of square configuration matching the square cross section of the spindle 22. When the spindle 22 is in position, the segment 36 engages only the cam 60 and the segment 38 engages only the cam 62 such that the cams 60 and 62 are individually and independently rotated about their respective hubs 64 and 66. The individual rotation of the cams is made possible by a feature of the present invention in which the segments 36 and 38 of the spindle 22 are rotatable, one with respect to the other. Upon operation of a door handle 12 in FIG. 1, only the segment 38 is rotated effecting rotation in turn of the cam 62. The rotation of the segment 36 by way of the handle 14 of FIG. 1 will rotate only the cam 60. The rotation of either one of the cams will effect a retraction or longitudinal movement of the latch slide 50 within the casing 20 to move the latch bolt to its inwardly retracted position.

The provision of two cams and a segmented spindle makes possible a locking and unlocking operation from only one side of a door to which the latching assembly is mounted. This feature or operation is provided in conjunction with the cams and spindle by a push button key comprised of the pushbutton 92 having an enlarged end 94 to be engaged by hand, either for moving the push button in or withdrawing the push button out, and a key 96 mounted for lateral movement within the casing 20. The key 96 is internally threaded at one end to receive a threaded portion 98 of the push button 92. When the push button 92 is moved inwardly, it moves the key 96 into engagement with a notch 100 formed in the end of the cam 60. In this position, the cam 60 is immobilized and the door handle on the outside of the door is ineffective to rotate the cam. The door is locked.

Release of the locked state is provided by way of a pin 102 received by a V-shaped groove 104 formed in the surface of cam 62 for providing a camming means or camming action which upon rotation of the cam 62 will move the key 96 from the receiving means or notch 100 of cam 60 to enable the rotation of the cam 60.

Figure 3:
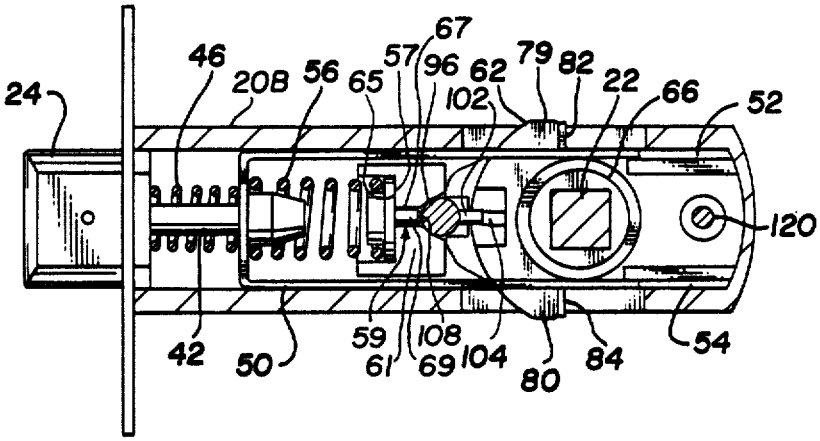
FIG. 3 is a partial cross section of the assembled latch mechanism with one side of the case removed.

Casing half 20B, FIG. 3, has formed thereon integral therewith on an inside surface thereof structure 61 which is provided with a semicircular recess 63 at one end thereof to receive half the shoulder 57 of detent means 59. The recess 63 terminates at 65 to provide a lease against which the shoulder 57 rests. In addition a semicircular groove 67 receives a reduced end portion 69 of the detent means with a tip or end 108 extending beyond the groove into contact with the key 96.

An opposite end 73 of the detent means 59 has an outside diameter of size to fit within an end of resilient means or helical spring 56 which urges or forces the shoulder 57 of the detent means against the base 65 of structure 61 and serves to cause the tip 108 of the detent means 59 to engage the surface of key 96. The end 108 of the detent means includes a roller like tip similar to that found on a ball-point pen to enhance relative movement between the tip and the key 96.

The other casing half 20A (FIG. 2) is provided with structure 75 similar to the structure 61. When the casing halves 20A and 20B are assembled the structures 61 and 75 provide recesses and cavities circular in nature to receive detent means 59 and an end of helical spring 58.

The structure 75 is provided with recess 77 to receive a guide bushing 81, preferably of plastic. The recess 77, of substantially square cross-section, extends through a wall of case half 20A. When mounted in recess 77, an outer end surface 87 of bushing 81 is even with the outer surface of the casing half 20A.

The guide bushing 81 is more fully illustrated in FIG. 2A. The guide bushing has a bore 83 throughout its length to receive key 96 and push rod 92. Shoulder 85 of the bushing 81 acts as a stop to position the bushing in the recess 77 so that the outer end surface 87 does not extend beyond the outer surface of casing half 20A. A semicircular recess 89 is provided in one wall of the bushing 81 to enable the end tip 108 of detent means 59 to engage the outer surface of key 96. An opposite wall of the bushing includes a recess 91 extending along the length of the bushing 91 to receive pin 102 and prevent rotation of key 96 as the key is moved toward and away from the cam 60.

The two halves 20A and 20B of the case 20 are secured together by the use of at least one machine screw 120 passing through the aperture 122 of the part 20A of case 20 and into a threaded portion (not shown) formed in the part 20B of the case 20.

It is apparent from the above construction and design that the removal of the machine screw 120 will permit the separation of the case halves 20A and 20B and thus enable one to gain access to the interior of the casing and to the various parts comprising the latch. Thus, if difficulty arises in the operation of the latch, such as the breaking of a part, one can readily gain access to the mechanism and substitute for that broken part without necessity of replacing the entire latch mechanism.

Referring now to FIG. 3 where the latch mechanism is shown partially in cross section with case half 20A removed. As illustrated, the latch bolt 24 is in its outwardly extended position under influence of the spring 46 urging between the base of the latch bolt 24 and the base 49 of the latch slide 50. The latch slide 50 is in its forward position under the influence of spring 56, one end of which engages the shoulder 57 of the detent means 59 and the other end of which surrounds a portion of the lever pin 42 and engages the underside of the base of the U-shaped latch slide.

The upper and lower portions 78, 80 of cam 62 extend through the slots 72 and 74 (not shown), respectively, in the latch slide 50 above and below the latch slide to engage the shoulders 82 and 84 of the latch slide. Similarly, the upper and lower portions 76, 78 of cam 60, directly behind the like parts of cam 62 engage the shoulders 82 and 84 of the latch slide 50. With the latch in an unlocked condition, rotation of the spindle 22 in either direction, that is clockwise or counterclockwise, will cause the latch slide 50 to move to the right, guided in the grooves 52 and 54 formed in the portion or side part 20B of the case 20 and against the force of spring 56 to move the latch bolt inwardly by pulling on the enlarged head of the lever pin 42.

Figure 4A:
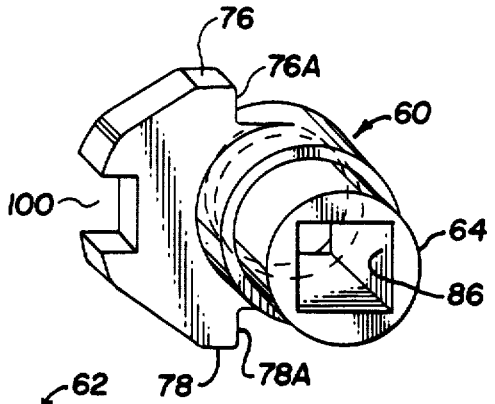
FIGS. 4A, 4B and 4C illustrate details of the cams comprising the operator.
Figure 4B:
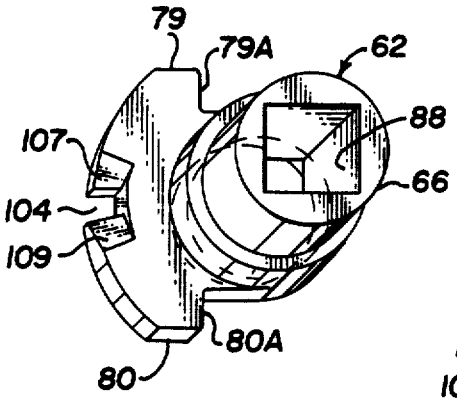
Figure 4C:
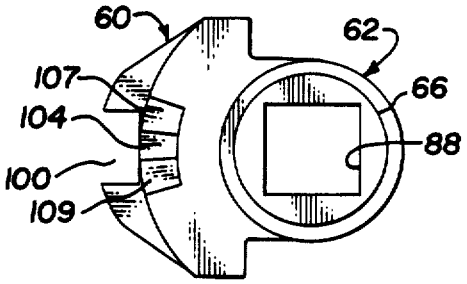

Further details of the cams 60 and 62 comprising the operator of the latch assembly are illustrated in FIGS. 4A, 4B and 4C. The outside cam 60, the cam adjacent the outside of a door, is shown in FIG. 4A to include the hub 64 of circular cross section and penetrated by an aperture 88 of square cross section to receive the spindle 22. The cam is provided with the diametrically opposed enlarged sections 76 and 78 whose rearward surfaces 76A and 78A provide the camming action by engaging the shoulders 82 and 84, respectively, of the latch slide 50 to move the latch slide longitudinally of the case 20 upon rotation of the cam 60. The cam 60 also is provided with the means for receiving at least a portion of the pushbutton key. This receiving means is provided by the notch 100 formed in the end of the cam 60.

The inside cam 62, the cam adjacent the inside of a door, is illustrated in greater detail in FIG. 4B. Like cam 60, cam 62 is provided with the enlarged upper portion 79 and the lower portion 80, the back surfaces of which respectively 79A and 80A will extend through the slots 72 and 74 of the latch slide 50 to engage respectively the shoulders 82 and 84 of the latch slide. The cam 62 includes the hub 66 of circular cross section and is pierced by a hole of square cross section to receive one of the segments 36 or 38 of the spindle 22.

A forward end of the cam 62 is provided with a V-shaped groove 104 to receive the pin 102 of the key 96. The base of the groove 104 is relieved at 105. The V-shaped groove provides two inclined camming surfaces 107 and 109 such that upon rotation of the cam 62 the pin 102 will ride up on either one of the two inclined surfaces of the groove, depending upon the direction of rotation of the cam. Upward movement of pin 102 moves the key 96 out of the notch 100 in cam 60, thus freeing the cam 60 for rotation and thus the operation of the latch assembly.

The relative positions of the cams 60 and 62 when mounted within the casing 20 is best illustrated in FIG. 4C. This figure illustrates the relative sizes of the cams, particularly the forward portions thereof. It will be noted that the notch 100 of cam 60 is beyond the end of cam 62 and located such that movement of the push button key laterally within the case 20 will not contact the forward portion of the cam 62. The pin 102 mounted to the key 96 will extend over the cam 62 toward its hub 66 and over the camming means or V-shaped groove formed in the forward portion of the cam 62.

Figure 5:
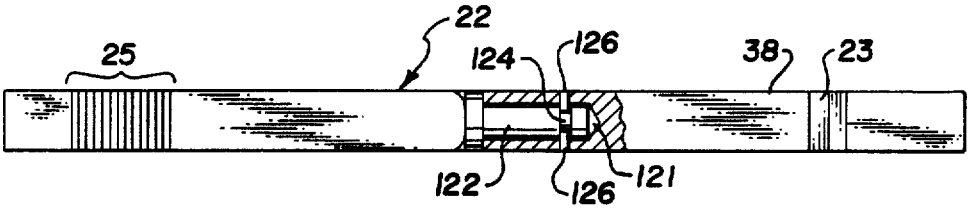
FIG. 5 is a front elevation, partially in cross section, of a spindle for rotating the cams comprising the operator.

The spindle 22 is illustrated in greater detail in FIG. 5 with portions of the spindle shown in cross section. As illustrated, segment 36 is provided with a cavity 121 bored into the end thereof and segment 38 has an end portion 122 of reduced circular cross section for insertion into the cavity 121. A groove 124 is formed intermediate the ends of the reduced portion 122 to receive one or more locking pins 126 which secure the two segments 36 and 38 together in rotational relationship.

The segment 38 is provided with a V-shaped groove to receive a set screw securing the handle or knob of the assembly to the spindle On the other hand, the segment 36 is provided with a plurality of adjacent grooves also to receive a set screw of the other knob or handle. The plurality of grooves is provided in order to take into account door widths of different thickness over a prescribed range.

While the invention has been illustrated and described herein with reference to a specific preferred embodiment, the invention is not limited thereto. Those skilled in the art may devise various changes, alternatives and modifications upon reading the foregoing description. It is intended that the invention include such changes, alternatives and modifications insofar as they fall within the spirit and scope of the appended claims.

What is claimed is:

1. A privacy door latch comprising an elongated case, a latch bolt mounted to reciprocate longitudinally in said case between outwardly extended and inwardly retracted positions, an operator rotatable about an axis extending transversely through said case, a driver operable to move said latch bolt longitudinally in response to rotation of said operator, a helical spring having one end engaging said driver, said operator comprising a first cam and a second cam, each having top and bottom portions engaging said driver to enable said driver by rotation of said operator in either a clockwise or counterclockwise direction to compress said spring, a push button key moveably mounted through a sidewall of said case and moveable in direction into and out of said case without engaging said second cam, said first cam having a portion for receiving at least a part of said push button key for locking said first cam against rotation when said key is in said receiving portion, said second cam having a camming means formed in a surface of said second cam adjacent said side wall of said case, said push button key including a pin mounted transversely of the movement of said key and extending beyond an end of said second cam for engagement with said camming means, whereby rotation of said second cam will move said push button key out of said receiving portion of said first cam to enable rotation of said first cam, and detent means in said case having one end in contact with an opposite end of said spring and an opposite end in contact with said push button key.

2. The privacy door latch of claim 1 in which said case includes structure providing means to receive said detent means.

3. The privacy door latch of claim 2 in which said means to receive said detent means includes a circular recess, an end of which is of reduced cross-section to provide a shoulder, said detent means including a flange received by said circular recess, and said helical spring having one end in contact with said flange to establish frictional contact between an end of said detent means and said push button key.

4. The privacy door latch of claim 2 in which said push button key has a notch in the surface thereof between an end of said key and said pin to receive an end of said detent means to maintain said key away from said first cam and said latch in an unlocked state.

5. The privacy door latch of claim 1 including a guide bushing extending through a wall of said case, said bushing having a bore therethrough, said key extending through said bore for guided movement toward and away from the interior of said case.

6. The privacy door latch of claim 5 in which said bushing is comprised of plastic.

7. The privacy door latch of claim 5 in which received end of said detent means terminates in a ballpoint.

8. The privacy door latch of claim 5 in which said guide bushing includes a slot for receiving said pin to prevent rotation of said key during movement of said key.

9. The privacy door latch of claim 5 in which said bushing includes a semicircular recess opening toward an interior end of said bushing to enable access of said detent means to the surface of said key.

10. The privacy door latch of claim 8 in which said bushing includes a semicircular recess in a side of said bushing opposite said slot, said recess opening toward an interior end of said bushing to enable access of said detent means to the surface of said key.

* * * * *